US006425192B2

(12) United States Patent
Arrieta et al.

(10) Patent No.: US 6,425,192 B2
(45) Date of Patent: Jul. 30, 2002

(54) CLOTHES DRYING AND DEWRINKLING CABINET

(75) Inventors: Luis Javier Arrieta; Alberto Albaizar, both of Mondragon (ES)

(73) Assignee: Fagor, S. Coop., Mondragon (ES)

( * ) Notice: Subject to any disclaimer, the term of this patent is extended or adjusted under 35 U.S.C. 154(b) by 0 days.

(21) Appl. No.: 09/791,475

(22) Filed: Feb. 22, 2001

(30) Foreign Application Priority Data

Mar. 13, 2000 (ES) ..... 200000597

(51) Int. Cl.[7] ..... F26B 3/00

(52) U.S. Cl. ..... 34/486; 34/527; 34/563; 34/66; 34/68; 34/202; 34/571

(58) Field of Search ..... 34/527, 563, 571, 34/66, 68, 202, 218, 233, 235, 486

(56) References Cited

U.S. PATENT DOCUMENTS

| | | | | | |
|---|---|---|---|---|---|
| 2,443,069 | A | * | 6/1948 | Gayring | 68/5 C |
| 3,670,425 | A | * | 6/1972 | Benjamin et al. | 34/46 |
| 3,805,561 | A | * | 4/1974 | Bullock | 68/5 C |
| 4,625,432 | A | * | 12/1986 | Baltes | 34/151 |
| 5,305,484 | A | * | 4/1994 | Fitzpatrick et al. | 8/149.3 |
| 5,815,961 | A | * | 10/1998 | Estes et al. | 38/14 |

* cited by examiner

*Primary Examiner*—William C. Doerrler
*Assistant Examiner*—Mark S Shulman
(74) *Attorney, Agent, or Firm*—The Kline Law Firm

(57) ABSTRACT

A cabinet for clothes drying and dewrinkling which comprises a main enclosure that defines an inner area for housing clothes, a fan for supplying air to the inner area, a steam generator for supplying steam to the inner area, a controller for regulating the air supply and steam supply, and at least one airing duct. The airing duct can be opened and closed by the controller.

5 Claims, 4 Drawing Sheets

CLOTHES DRYING AND DEWRINKLING CABINET

TECHNICAL FIELD

The present invention relates to clothes drying and dewrinkling systems and more specifically to clothes drying and dewrinkling cabinets intended mainly for domestic use.

PRIOR ART

It is a proven fact that one of the most disagreeable household chores is the process that starts off when clean clothes (garments, sheets, etc.) are taken out of the washing machine and finishes when they are stowed away in the respective wardrobe duly ironed (hanging the washing taken out of the washing machine, bringing it in when dry, organizing the ironing thereof, etc.).

There have been many attempts to expedite and simplify this process, but no household domestic appliance has been developed to date offering a complete and final solution.

Clothes drying cabinets are well known, but they only offer a partial solution to the task that starts after the washing has been done, its main contribution being the speeding-up of the drying process. JP09313793, for instance, claims a booth for clothes drying by means of hot air.

Cabinets are also well known that set out to dewrinkle clothes and which use hot air and steam for this purpose. Thus EP0324589 discloses a cabinet for the steaming and subsequent drying of clothes for their dewrinkling. This cabinet only offers a partial solution to the process which begins after removing the clean clothes from the washing machine. Furthermore, the steaming and drying method claimed by EP0324589 requires the clothes to be dewrinkled to be stretched out inside the cabinet.

What is more, the steam diffusion means proposed by EP0324589 are of a complexity that may be avoided and at the same time optimal steaming cannot be assured.

Lastly, the size of the interior area of the EP0324589 cabinet is not the most suited either for the ends pursued (facilitating the operations that begin after the clothes are washed and conclude after their ironing), as said cabinet does not have sufficient capacity to hold the clothes corresponding to a wash.

DISCLOSURE OF THE INVENTION

The object of the invention is a cabinet for drying and dewrinkling clothes and a method for carrying out said drying and dewrinkling, as defined in the claims.

The user may put all the clean clothes (garments, sheets, etc.) taken out of the washing machine directly into the cabinet which is the object of the present invention, where the subsequent drying and dewrinkling of said clothes is carried out, besides acting also as a storage place for the clothes until they are transferred to their respective wardrobe. All this is no impediment either to the cabinet of the present invention being able to dewrinkle dry clothes or to its being used merely as a drying cabinet.

The level of dewrinkling that is achieved is such that the subsequent use of an iron is only required for a small number of garments and only for very localized parts thereof. Furthermore, it is not necessary to stretch out the clothes but merely to lay them on the racks provided in the actual cabinet.

The cabinet that is the object of the present invention has means to supply air and steam to its interior area and devices for the control of said means, at least one airing duct, and means for the opening and closing of said airing duct, also operated by way of said control devices.

The invention includes a method for dewrinkling clothes in the interior area of the cabinet, which comprises a steam supply stage, a clothes resting stage, and an air supply stage, the airing duct being either open or closed depending on the stage that the dewrinkling process has reached. For wet clothes there is an initial drying stage by means of the delivery of air.

The possibility of opening or closing the airing duct in accordance with the stage the dewrinkling process has reached enables the results to be optimised both at the drying and at the steaming and resting stages. In fact, it is this option of opening or closing the airing duct which makes it possible to combine the drying of wet clothes (clothes taken straight out of the washing machine) and their subsequent dewrinkling in the same cabinet.

Thus, at the initial drying stage (in the case of wet clothes) and at the drying stage after steaming, the airing duct will be kept open so that there is air circulation and moisture is drawn out either to the outside or else to a condensation system provided for this purpose at the output of said airing duct. At the steaming and resting stages, however, said airing duct will be kept closed. In this way, at the steaming stage this will help the clothes to be saturated in steam through preventing the steam from escaping to the exterior. Likewise, at the resting stage the fact of keeping the airing duct closed will assist in stabilising the clothes by preventing air currents to the exterior.

As regards the resting stage, the tests carried out have shown that the introduction of said stage after the steaming stage brings a considerable improvement in the dewrinkling results. In this way, the method of dewrinkling covered by the invention improves on those methods, like that claimed in EP0324589, which introduce the air delivery stage straight after the steaming stage.

Another important feature of the invention is that, as regards the steam supply methods, the steam diffuser is eliminated. The steam is supplied through a duct communicating the tank in which the steam is generated, which is located below the inner area of the cabinet, directly with said inner area. The steam may either be generated in this way or else by supplying air at the same time, so that said air assists in the even distribution of the steam. In this way, the steam supply means are simplified considerably and optimal results are obtained. This design, much simpler for instance than that proposed in EP0324589, makes volume production of the cabinet much more feasible.

On the other hand, a common problem in cabinets of this type is condensation. Tests performed have shown that the cabinet that is the object of the present invention gives no problems of this type. A factor that contributes to this is, together with the use of a thermally insulating material for the forming of the cabinet, the fact that the steam is supplied to the inner area by way of a duct that communicates the steam generating tank and said inner area directly, so that said steam does not undergo any loss of energy in reaching said inner area.

DETAILED DISCLOSURE OF THE INVENTION

Figure 1:
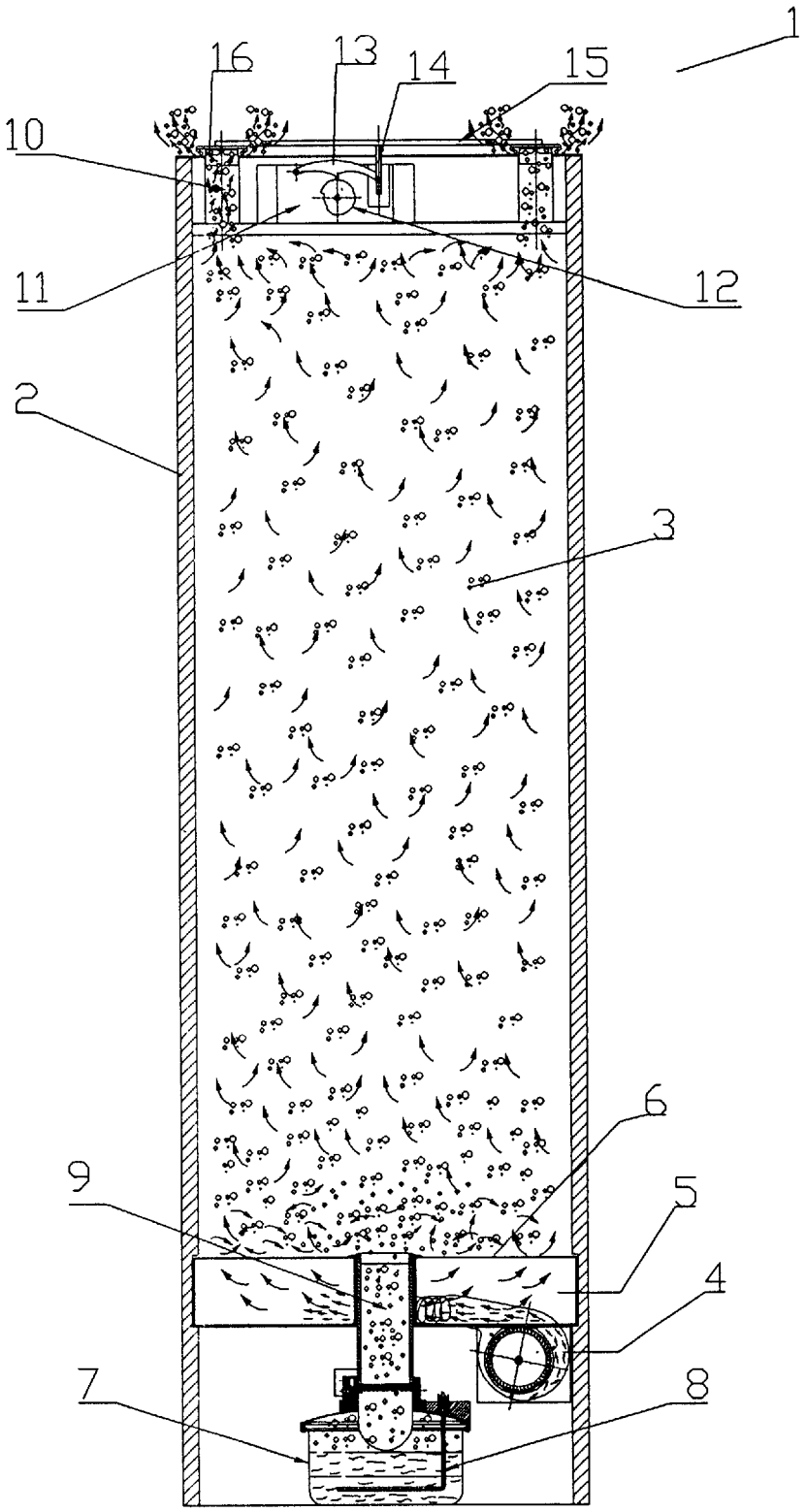
FIG. 1 is a front view of an embodiment of the cabinet that is the object of the present invention.

An example of an embodiment of the cabinet that is the object of the present invention is that shown in FIG. 1. Cabinet 1 may have one or more airing ducts 10 and the programmer 11 may be sited at different places in the cabinet 1. This programmer may be either electronic or electromechanical.

Figure 2:
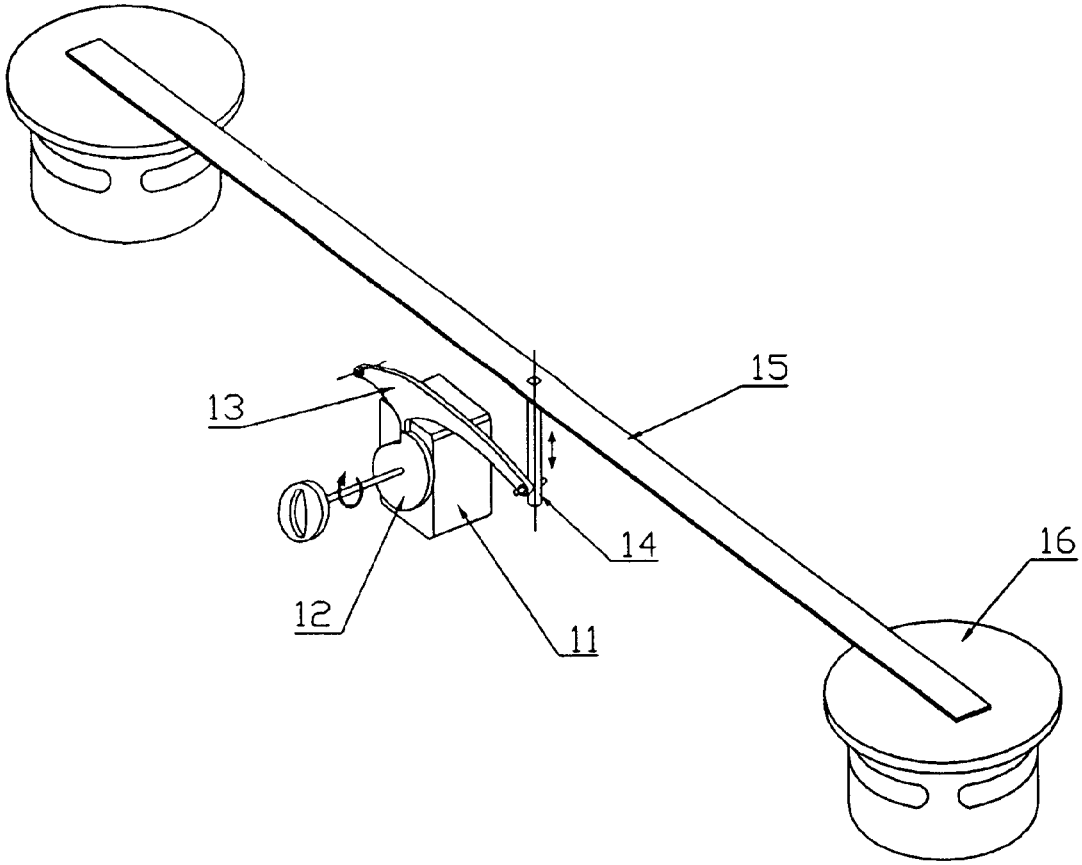
FIG. 2 is a perspective view of an embodiment of the cabinet airing duct opening and closing means through the use of an electromechanical programmer.

It may be observed in the example in FIG. 1 that the cabinet has two airing ducts 10 and the programmer 11 is an electromechanical programmer which is situated at the top of the cabinet 1. As shown in the close view in FIG. 2, in this embodiment the cam follower 13, which rests on the cam 12 of the programmer 11, is linked to a vertical shaft 14, which is in turn linked to a horizontal rod 15, attached to the seals 16. In this way, the seals 16 open or close in accordance with the position of the programmer 11. Naturally, if the programmer 11 were electronic, the transmission means would be different.

In reference again to FIG. 1, the steam supply means include a tank 7 with a resistance 8 that heats the water of said tank 7 to generate steam. Said steam has free access to the inner area 3 by way of a central duct 9.

Figure 3:
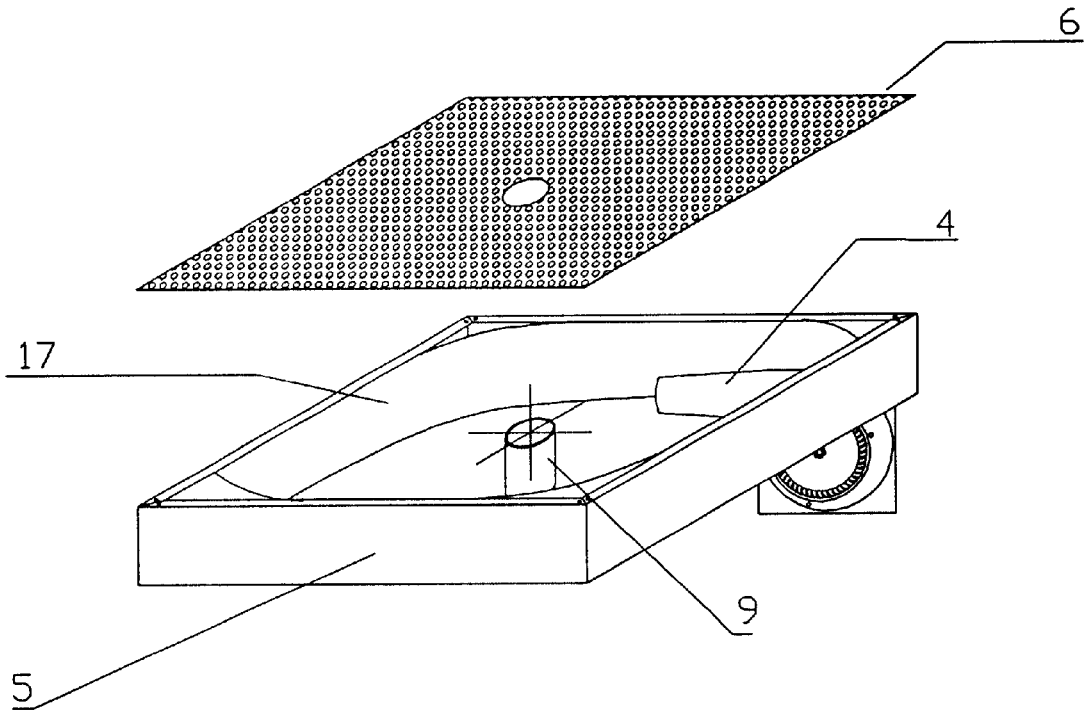
FIG. 3 is an exploded view of an embodiment of the air supply means of the cabinet that is the object of the present invention.

FIG. 3 shows the air supply means, which in this embodiment comprise a fan 4, a ventilation body 5 and a diffuser grille 6, all situated below the inner area 3. The ventilation body 5 is a thermally insulating drawer on which the diffuser grille 6 is fitted. The air output of the fan 4 is directed towards the inner wall 17 of the ventilation body 5. Said inner wall 17 defines a curving sealed enclosure with a circular or quasi-circular perimeter, wider at the top than at the base. The surface of the inner wall 17, seen in a cross-sectional view, constitutes a concave line.

The form of the inner wall 17 assists rotation of the air flow inside the ventilation body 5, which contributes to the even distribution of said flow to the inner area. The slope of said wall, in turn, directs the air towards the diffuser grille 6, so that it is transmitted to the inner area 3 in a swirling movement.

Figure 4:
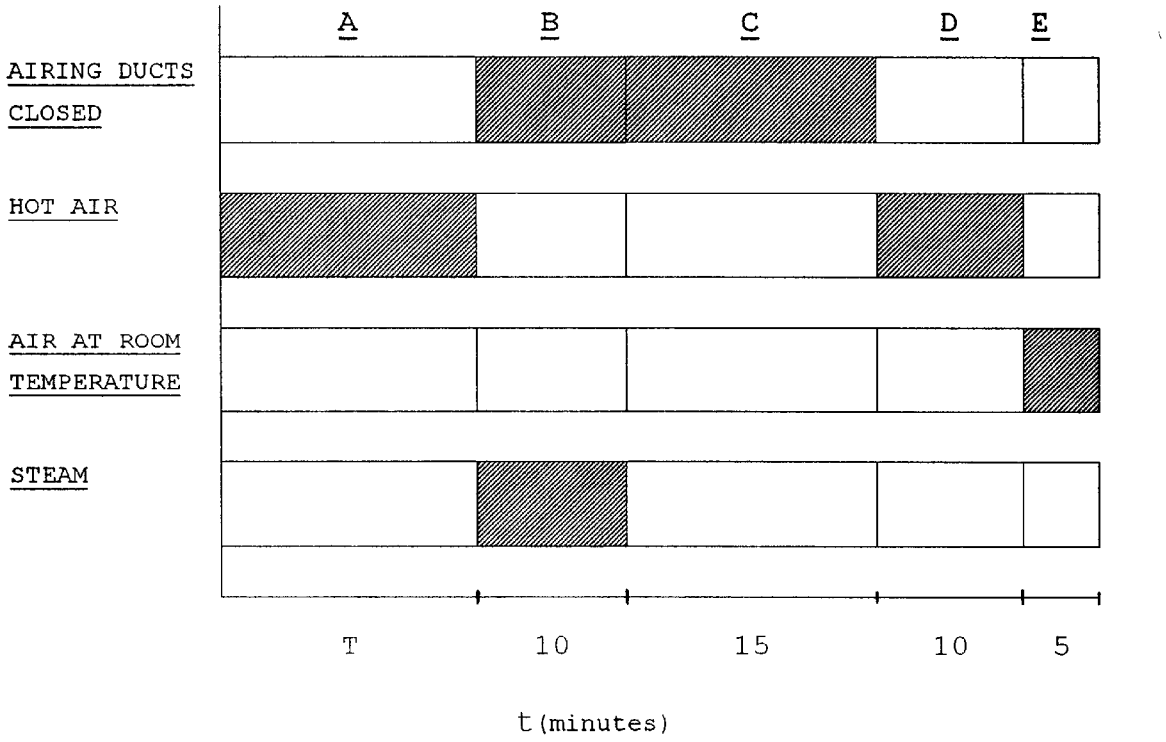
FIG. 4 is a graph showing the different drying and dewrinkling stages of one example of the method that is the object of the present invention.

FIG. 4 shows the wet clothes dewrinkling cycle according to the method of the invention. The clothes dewrinkling cycle will include only stages B, C, D and E, which are shown in the aforesaid FIG. 4. Said dewrinkling stages have the following features:

Stage B, steam supply to the inner area 3 to saturate the clothes with steam. The airing ducts 10 are kept closed, so that there is no steam loss.

Stage C, rest, in which neither steam nor air is supplied so as to stabilise the clothes, so that dewrinkling takes place. The airing ducts 10 remain closed, which assists in stabilising the clothes, as the enclosure remains completely sealed.

Stage D, hot air supply to dehumidify the clothes. At this stage the airing ducts 10 are open, so that the hot air can issue from said ducts 10.

Stage E, air supply at room temperature to normalise the conditions of the inner area 3, which saves the user from receiving a surge of hot air on opening the door of the cabinet 1. The airing ducts remain open.

For the dewrinkling of wet clothes, the dewrinkling method also comprises a previous drying stage A by means of air supply of a given duration T, while the airing ducts 10 remain open.

As regards the steam supply stage, in an initial embodiment said steam is distributed by means of the mere delivery of steam through the central duct 9 (this is the case shown in FIG. 4). In a second embodiment there is simultaneous continuous or intermittent delivery of air by way of the diffuser grille 6, with the air acting as the steam diffuser.

The times for stages B, C, D and E, which are shown in FIG. 4 (10, 15, 10 and 15 minutes, respectively), merely represent an example of what said stages may last so that the results will be satisfactory, without their being in any way restrictive as to the object of the invention.

Besides a drying and dewrinkling cycle and a dewrinkling cycle only for already dry clothes, the cabinet 1 may include an independent drying cycle with air at room temperature and an independent drying cycle with hot air, the airing ducts 10 being open in these last two cases.

What is claimed is:

1. A cabinet for clothes drying and dewrinkling comprising:

a main enclosure that defines an inner area to receive clothes, air delivery means for supplying air to said inner area, steam delivery means for supplying steam to said inner area, at least one airing duct, and automatic control means for regulating both said air delivery means and said steam delivery means; wherein said automatic control means automatically controls at least one drying and dewrinkling process, and said automatic control means also regulates a means to open and close said at least one airing duct, opening and closing of said at least one airing duct being used to optimize a dewrinkling cycle and to enable a wet clothes drying cycle.

2. The cabinet according to claim 1, wherein:

said automatic control means comprises a programmer, and said means to open and close said at least one airing duct comprises a seal for each said airing duct and transmission means controlled by said programmer, said transmission means opening and closing each said seal of each said airing duct.

3. The cabinet according to claim 1, wherein:

said steam delivery means comprises a tank situated below said inner area and centered beneath said inner area, said tank being in communication with said inner area by means of a central duct.

4. The cabinet according to claim 1, wherein:

said air delivery means is situated below said inner area, said air delivery means comprising a fan regulated by said automatic control means, said fan including air heating means, said air heating means also being regulated by said automatic control means, said air delivery means further comprising a ventilation body and a diffusing grill that covers said ventilation body; wherein an inner wall of said ventilation body is a substantially circular sealed enclosure, said ventilation body being wider at a top end thereof that at a base thereof, and said fan is directed toward said inner wall so that air is transmitted in a uniform dispersal pattern to said inner area through said diffusing grill.

5. A cabinet for clothes drying and dewrinkling comprising:

a main enclosure that defines an inner area to receive clothes, air delivery means for supplying air to said inner area, steam delivery means for supplying steam to said inner area, automatic control means for regulating both said air delivery means and said steam delivery means, and at least one airing duct; wherein said automatic control means automatically controls said at least one airing duct, said steam delivery means, and said air delivery means to perform a dry clothes dewrinkling cycle, a wet clothes dewrinkling cycle, and a wet clothes drying cycle.

* * * * *